United States Patent [19]

Wöbking

[11] 4,140,596

[45] Feb. 20, 1979

[54] PROCESS FOR THE ELECTROLYTIC REFINING OF COPPER

[75] Inventor: Hans Wöbking, Innsbruck, Austria

[73] Assignee: Vereinigte Metallwerke Ranshofen-Berndorf Aktiengesellschaft, Braunau am Inn/Ranshofen, Austria

[21] Appl. No.: 818,332

[22] Filed: Jul. 22, 1977

Related U.S. Application Data

[63] Continuation-in-part of Ser. No. 741,414, Nov. 12, 1976, abandoned.

[30] Foreign Application Priority Data

Dec. 22, 1975 [AT] Austria ..... 9732/75

[51] Int. Cl.[2] ..... C25C 1/12

[52] U.S. Cl. ..... 204/108; 204/52 R; 204/DIG. 9

[58] Field of Search ..... 204/DIG. 8-9, 204/108, 52 R

[56] References Cited

U.S. PATENT DOCUMENTS

| | | | |
|---|---|---|---|
| 2,451,341 | 10/1948 | Jernstedt | 204/DIG. 9 |
| 3,535,218 | 10/1970 | Brown et al. | 204/108 |
| 3,824,162 | 7/1974 | Sakai et al. | 204/DIG. 8 |
| 3,864,227 | 2/1975 | Brytczuk et al. | 204/108 |

*Primary Examiner*—R. L. Andrews
*Attorney, Agent, or Firm*—Karl F. Ross

[57] ABSTRACT

A process for the electrolytic refining of metals, especially copper, in which the copper is deposited from an electrolyte on the cathode of an electrolytic cell which comprises periodically reversing the current with a forward pulse time of 2 to 9 seconds and a reverse pulse time of 0.1 to 0.45 seconds.

1 Claim, 1 Drawing Figure

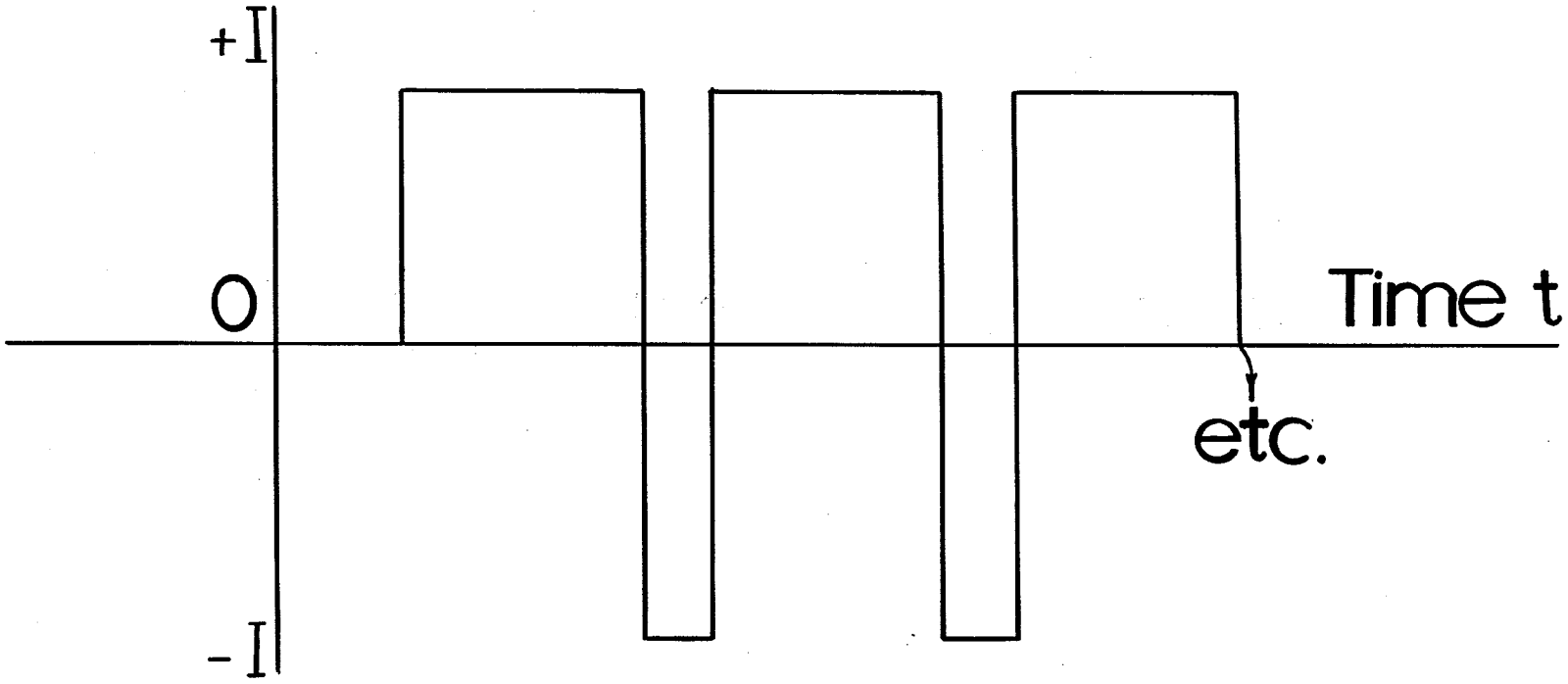
+I
O
-I
Time t
etc.

PROCESS FOR THE ELECTROLYTIC REFINING OF COPPER

CROSS REFERENCE TO RELATED APPLICATION

This application is a continuation-in-part of Ser. No. 741,414 filed 12 Nov., 1976, now abandoned.

FIELD OF THE INVENTION

The present invention relates to a process for the electrolytic refining of metals and, more particularly, to the electrolytic refining of copper.

BACKGROUND OF THE INVENTION

In the electrolytic refining of metals, especially the electrolytic refining of copper, the deposition of copper at the cathode from the electrolyte, especially from an impure copper anode is carried out with a current density usually between 150 and 300 amperes per $m^2$. The individual electrolysis baths are connected in series, i.e. one after the other.

For a given current flow, the production rate per unit time of cathodic copper, i.e. the amount of copper deposited at the cathodes per unit time, is a function of the number of cells and the current efficiency.

It has been recognized that it is possible to obtain an increase in the production rate by raising the number of electrolysis cells. The disadvantage of this technique is that it involves increased investment costs for additional electrolysis tanks, rails, piping, electrolyte, pumps and baths. Furthermore, it requires an increase in the copper stock and the use of rectifiers and transformers of greater output.

Another way of increasing production, already recognized in the art, is to increase the current. High current densities have, however, the disadvantage that the overvoltage at the cathode increases disproportionately so that undesirable metals, for example lead, antimony, bismuth, selenium, iron and arsenic, are deposited at the cathode in addition to the desired metal, namely, copper. Then it is necessary to avoid the deposition of such impurity metals, the current density is, as has been recognized in the art, limited to about 300 amperes per $m^2$.

A slight increase in the production rate can be obtained by increasing the current efficiency.

As long as one operates with current densities below 900 amperes per $m^2$, the increase in current is the simplest and least expensive method of raising production rate as long as the deposition of impurity metals at the cathode is acceptable. If such deposition is not acceptable, the use of increased currents must be accompanied by attempts to lower the overvoltage at the cathode.

It is known in the art (see French Pat. No. 1,412,438, English Pat. No. 1,157,686 and U.S. Pat. No. 3,864,227) to provide a current reversal process which has the function of eliminating passivation characteristics at the anode.

OBJECT OF THE INVENTION

It is the principal object of the present invention to provide a process for the electrolytic refining of metals, especially copper, in which disadvantages of earlier systems are obviated and which has improved output of the cathodically deposited metal.

SUMMARY OF THE INVENTION

This object and others which will become apparent hereinafter are attained, in accordance with the present invention with a process which uses current reversal with very short cycling times to reduce or eliminate the concentration polarization voltage at the cathode and yet allow especially high current densities to be employed with a qualitative improvement of the cathodes, avoiding the deposition of the impurity elements mentioned above and providing a deposited metal cathode of satisfactory density and surface characteristics.

According to this invention, the current is periodically reversed, i.e. the polarities of the anode and cathode are alternated. The electrolysis according to the invention is carried out with a pulsed electric current which alternates positive and negative current pulses with a forward pulse time of 2 to 9 seconds and a reverse pulse time of 0.1 to 0.45 seconds. These parameters are critical and the limits of the ranges must be observed strictly to obtain the desired effect. More specifically, the overvoltage can be reduced to a value which appears to have the same effect as with conventional direct current electrolysis. The ratio between the forward current and reverse current amplitudes can be between 10:1 and 1:1.

BRIEF DESCRIPTION OF THE DRAWING

In the sole FIGURE of the drawing there is illustrated a graph showing the current characteristics plotted against time of a pulse train for the electrolysis of copper according to the invention.

SPECIFIC DESCRIPTION AND EXAMPLE

As can be seen in the drawing, in which current amplitude is plotted along the ordinate against time as the abscissa, the duration of the positive current pulses (forward current pulses or cathode-deposition pulses) is greater by several times than the reverse current pulses or negative current pulses which are ineffective to deposit metal at the cathode but effect a cathode depolarization as previously described. In the embodiment illustrated, the forward and reverse current pulses have the same amplitude although the amplitude ratio between forward current pulses and reverse pulses can range between 10:1 and 1:1 as previously described.

SPECIFIC EXAMPLES

1. An electrolyte (aqueous) of the following composition was used:

copper 40–48 grams per liter
$H_2SO_4$ 150 to 200 grams per liter
arsenic 2 to 10 grams per liter
nickel 15 to 25 grams per liter The system was used to deposit copper from impure copper anodes on conventional copper cathodes.

The anode composition was as follows (all percents by weight):

copper 98.5 – 99.0%
nickel 0.35 to 0.40%
arsenic 0.20%
lead 0.15%
antimony 0.04%

The copper deposit (at the cathode) was substantially 100% copper.

It was found that 1 ton of cathodic copper could be deposited with 5 to 10% less electrical energy consumption in comparison with DC if the rate of deposition is constant.

In the application presented here an electrolytic process has forward pulses 2 to 9 seconds wide and reverse pulses with impulse widths of 0.1 to 0.45 seconds. By means of the application of these special forward and reverse pulses, with an amplitude relationship of 10:1 to 1:1, a reduction of the cathodic overvoltage and with that a better cathodic quality even with increased current density is assured.

2. Large scale copper affinity electrolysis, Vereinigte Metall-Werke Ranshofen — Berndorf AG — Montanwerke Brixlegg, (Austria):

| Process | Forward current density | Forward time | Reverse time | Impurities in the cathodes Pb | Sb | Ni | Fe | Ag |
|---|---|---|---|---|---|---|---|---|
| | | | | ppm | | | | |
| DC | 157 A/m$^2$ | — | — | 11 | 15 | 6 | 8 | 11 |
| PCR | 182 Alm$^2$ | 9.0 sec | 0.450 sec | 11 | 13 | 7 | P | 11 |
| PCR | 218 Alm$^2$ | 8.5 sec | 0.425 sec | 8 | 7 | 8 | 8 | 8 |
| PCR | 293 Alm$^2$ 8.0 *sec* | 0.400 sec | 4 | 4 | 4 | 4 | 10 | |
| PCR | 313 Alm$^2$ | 7.5 sec | 0.375 sec | 3 | 2 | 4 | 4 | 8 |

3. Laboratory tests, Vereinigte Metallwerke Ronshofen — Berndorf AG, Montanwerke Brixlegg (Austria). It was discovered experimentally that optimum forward times slack off with increased current density.

| Forward current density | Optimum forward time | Optimum reverse time |
|---|---|---|
| 400 A/m$^2$ | 7.1 sec | 0.355 sec |
| 600 A/m$^2$ | 5.6 sec | 0.280 sec |
| 800 A/m$^2$ | 4.7 sec | 0.235 sec |
| 1000 A/m$^2$ | 4.2 sec | 0.210 sec |
| 1500 A/m$^2$ | 3.3 sec | 0.155 sec |

Furthermore, the following characteristics of the process were observed:

(a) The effective current efficiency was found to be approximately the same as with direct current deposition of cathodic copper at 300 amperes per m$^2$ in spite of the markedly higher current amplitude and frequently the current efficiency with the system of the invention was higher, i.e. the number of short circuits per ampere per m$^2$ developed was reduced by comparison to the number obtained with a strict direct current process.

(b) Per ton of cathodic copper, the consumption of electrical energy was decreased with respect to the direct current values by 5 to 10%.

(c) The generator voltage for the electrical current generator used in the system could be held about 5 to 10% lower than with the direct current process.

(d) It was found that the electrolyte circulation rate in the bath could be reduced in proportion to the increase in the current so that substantially lower electrolyte circulation rates could be used with the system of the invention by comparison to the direct current process.

(e) It was found that the requirements of inhibitors customarly added to the electrolyte did not grow as rapidly as the increase in current and hence relative to the current amplitude, less glue and thiourea was required in the bath.

(f) Passivation phenomena did not occur at the anode or were reduced.

(g) High impurity levels could be sustained in the electrolyte without markedly reducing the quality of the cathode obtained and hence higher impurity levels could be sustained in the electrolyte than is the case with the direct current process and at the same time an improvement in cathode quality was observed.

(h) The anode impurity level can be higher without reducing the level of impurities incorporated in the cathode.

(i) Since the increased resistive heating of the bath accompanying the use of higher current densities raises the temperature of the bath during the process, the need for steam heating of the bath can be reduced or eliminated. The saving in steam can compensate at least partly for the increased cost of electrical energy at high current densities which must be consumed per ton of deposited cathodic copper.

(j) The high current densities do not effect the ability to form easily strippable cathode layers with uniform smooth surfaces.

(k) The cathode quality, even with higher current densities, is equal to greater than the quality of cathodes obtained with convention direct current electrodeposition. The structure of the cathode is fine grain.

(l) In decoppering, the generation of compact cathodes is possible.

Of course, the present process is not limited exclusively to copper but can be used for the electrowinning of all electrolytically depositable metals.

I claim:

1. In a process for the electrolytic deposition of copper at a cathode from an electrolytic bath at an effective temperature by passing an electric current and a suitable current density through said bath between an anode and a cathode, the improvement wherein:

the current flow is periodically reversed and has a forward pulse time of 2 to 9 seconds and a reverse pulse time of 0.1 to 0.45 seconds;

the ratio of the metal-deposition current to the reverse current is between 10:1 and 1:1;

the anode has the following composition:

98.5 to 99.0% by weight copper
0.35 to 0.40% by weight nickel
about 0.20% by weight arsenic
about 0.15% by weight lead, and
about 0.04% by weight antimony; and the bath is aqueous and consists essentially of:

40 to 48 g/l copper
150 to 200 g/l sulfuric acid
2 to 10 g/l arsenic; and
15 to 25 g/l nickel.

* * * * *